US011077993B2

(12) United States Patent
Baumann

(10) Patent No.: US 11,077,993 B2
(45) Date of Patent: Aug. 3, 2021

(54) DISCHARGE HEAD FOR A LIQUID DISPENSER AND LIQUID DISPENSER HAVING SUCH A DISCHARGE HEAD

(71) Applicant: Tobias Baumann, Constance (DE)

(72) Inventor: Tobias Baumann, Constance (DE)

(73) Assignee: APTAR RADOLFZELL GMBH, Radolfzell (DE)

( * ) Notice: Subject to any disclaimer, the term of this patent is extended or adjusted under 35 U.S.C. 154(b) by 0 days.

(21) Appl. No.: 16/346,157

(22) PCT Filed: Nov. 10, 2017

(86) PCT No.: PCT/EP2017/078938
§ 371 (c)(1),
(2) Date: Apr. 30, 2019

(87) PCT Pub. No.: WO2018/091377
PCT Pub. Date: May 24, 2018

(65) Prior Publication Data

US 2020/0055643 A1 Feb. 20, 2020

(30) Foreign Application Priority Data

Nov. 17, 2016 (DE) ..... 10 2016 222 682.7

(51) Int. Cl.
*B65D 47/18* (2006.01)
*B65D 47/20* (2006.01)
*A45D 34/00* (2006.01)

(52) U.S. Cl.
CPC ..... *B65D 47/18* (2013.01); *B65D 47/2075* (2013.01); *A45D 34/00* (2013.01)

(58) Field of Classification Search
CPC ... B05B 11/04; B05B 11/0062; B05B 11/007; B05B 11/073; B05B 11/0075;
(Continued)

(56) References Cited

U.S. PATENT DOCUMENTS 3,874,562 A * 4/1975 Hazard ..... B65D 47/305 222/209
4,506,809 A * 3/1985 Corsette ..... B65D 47/2081 222/213

(Continued)

FOREIGN PATENT DOCUMENTS

EP 2 949 593 A1 12/2015
WO 2011/079301 A1 6/2011
WO 2014/205587 A1 12/2014

OTHER PUBLICATIONS

International Search Report issued in Application No. PCT/EP2017/078938 dated Jan. 30, 2018 (5 pages).

(Continued)

*Primary Examiner* — Paul R Durand
*Assistant Examiner* — Randall A Gruby
(74) *Attorney, Agent, or Firm* — Flynn Thiel, P.C.

(57) ABSTRACT

A discharge head having a housing, a coupling device for attachment to a liquid store, a discharge opening and an outlet channel extending from an inlet region up to the discharge opening and by which the discharge opening is supplied with liquid. For throttling the liquid to be discharged, the discharge head has a throttle device with a throttle channel for reduction in the liquid pressure and/or the liquid flow through the throttle device. The throttle device is switchable between throttling and release states, and a minimum free cross section of the throttle channel is varied to subject liquid flowing in the direction of the discharge opening to a high throttling effect in the throttling state and liquid flowing in the direction of the inlet region is subjected to a low throttling effect in the release state.

21 Claims, 8 Drawing Sheets

(58) Field of Classification Search
CPC .... B65D 47/18; B65D 47/08; B65D 47/0804; B65D 47/2031; B65D 47/2075
USPC ..... 222/212, 213, 511, 514, 518
See application file for complete search history.

(56) References Cited

U.S. PATENT DOCUMENTS 4,811,871 A * 3/1989 Wass ..... B67C 9/00 222/477
5,074,440 A * 12/1991 Clements ..... B05B 11/047 222/189.09
5,680,969 A * 10/1997 Gross ..... B65D 47/242 222/494
5,904,275 A * 5/1999 Suffa ..... B65D 47/2037 222/494
5,944,234 A * 8/1999 Lampe ..... B65D 47/0804 222/490
6,095,382 A * 8/2000 Gross ..... B65D 47/242 215/271
6,250,503 B1 * 6/2001 Dark ..... B65D 47/2018 222/1
6,269,986 B1 * 8/2001 Gross ..... B65D 47/0804 222/541.5
6,415,961 B2 * 7/2002 Bonningue ..... G01F 11/04 222/205
6,523,711 B1 * 2/2003 Hughes ..... A47G 19/2266 215/308
6,543,652 B1 * 4/2003 Kelder ..... B65D 47/2037 222/212
6,672,479 B2 * 1/2004 Shiraishi ..... B65D 23/02 222/105
7,681,750 B2 * 3/2010 Jackel ..... B65D 47/2037 215/235
7,784,652 B2 * 8/2010 Gaus ..... B65D 47/2031 222/494
8,528,791 B2 * 9/2013 Fernandez de Mendiola Quintana ..... B65D 47/0838 222/213
8,596,501 B2 * 12/2013 Hagleitner ..... A47K 5/13 222/207
8,608,034 B2 * 12/2013 Bloom ..... B65D 51/18 222/490
9,682,804 B2 * 6/2017 Hatton ..... B65D 47/2025
9,815,599 B2 * 11/2017 Spiegelhoff ..... B65D 35/46
10,173,815 B2 * 1/2019 Greiner-Perth ..... B65D 50/04
10,179,680 B2 * 1/2019 Kim ..... B65D 47/121
10,322,855 B2 * 6/2019 Heiberger ..... B65D 47/247
10,422,679 B2 * 9/2019 Geissler ..... G01F 11/32
2006/0111680 A1 * 5/2006 Spada ..... B65D 47/18 604/295
2011/0144598 A1 * 6/2011 Mihashi ..... B65D 47/18 604/295
2013/0270301 A1 * 10/2013 Schoubben ..... G01F 11/265 222/207
2014/0151404 A1 * 6/2014 Lehmkuhl ..... B65D 41/0471 222/153.14
2014/0231462 A1 * 8/2014 Ray ..... A47K 5/122 222/207
2015/0335475 A1 11/2015 Lamboux et al.
2018/0113017 A1 * 4/2018 Hoefte ..... G01F 11/06
2020/0009548 A1 * 1/2020 Duquet ..... F16K 23/00

OTHER PUBLICATIONS

Written Opinion issued in Application No. PCT/EP2017/078938 dated Jan. 30, 2018 (5 pages).
Office Action of German Patent Office issued in German Application No. 10 2016 222 682.7 dated May 8, 2017 (5 pages).

* cited by examiner

DISCHARGE HEAD FOR A LIQUID DISPENSER AND LIQUID DISPENSER HAVING SUCH A DISCHARGE HEAD

FIELD OF APPLICATION AND PRIOR ART

The invention relates to a discharge head for a liquid dispenser, and to a liquid dispenser with such a discharge head. Preferably, a discharge head or a liquid dispenser for the release of cosmetic or pharmaceutical liquids in drop form is involved.

Liquid dispensers of the type in question and the discharge heads thereof are normally designed for dispensing liquid, which is supplied in a predefined liquid flow range and/or pressure range, in the desired form, that is to say for example in the form of individual drops. If the liquid dispenser is supplied with liquid which is conveyed directly by the user, it is however not possible to ensure a precisely defined supply pressure or supply liquid flow. In this regard, a user can for example compress a squeeze bottle with considerably greater intensity than that which is intended.

Provision is therefore made in a liquid dispenser of the type in question of a throttle device, that is to say a sub-section, within which, for example owing to close covers, a sufficiently high friction in the liquid and between the liquid and walls is brought about in order to sufficiently lower an excessively high liquid pressure. In the context of the above-mentioned drop dispenser in particular, this plays a major role, since only by such throttling is it possible to ensure that the application of pressure to the liquid by the user does not give rise to a discharge jet instead of drops.

However, such a throttle device is also a problem in various respects. In particular, it can undesirably prevent liquid from the outlet channel from being sucked back into the liquid store by way of the negative pressure, which has arisen in the liquid store, after the discharge process has ended. Whereas the differential pressure between the liquid store and surroundings can be significantly above 1 bar during discharge, out of principle, the negative pressure for the sucking-back of liquid from the outlet channel into the liquid store can never be greater than 1 bar. In practice, said pressure is significantly below this.

Problem and Solution

The problem addressed by the invention is therefore to refine a discharge head of the type in question to the extent that this not only permits throttled release of liquid, in particular in drop form, but also reliably makes possible emptying or partial emptying of the outlet channel in the direction of the liquid store after the discharge process has been completed.

For the solution of this problem, a discharge head having a housing and a coupling device for attachment to a liquid store is proposed. The discharge head also has a discharge opening through which liquid is able to be dispensed into a surrounding atmosphere, and an outlet channel which extends from an inlet region, pointing in the direction of the liquid store, up to the discharge opening and by means of which the discharge opening is able to be supplied with liquid.

The discharge head has, in the outlet channel, a throttle device with a throttle channel for the reduction in the liquid pressure and/or the liquid flow of the liquid flowing through the throttle device.

According to the invention, the throttle device is designed in the form of a switchable throttle device in which, between a throttling state and a release state, a minimum free cross section of the throttle channel is able to be varied. Liquid flowing out in the direction of the discharge opening is subjected to a higher throttling effect than liquid flowing back in in the direction of the inlet region.

The design according to the invention consequently provides that the throttle device performs greater throttling during the discharge of liquid, that is to say removes from the liquid a higher proportion of the energy, provided by way of positive pressure in the liquid store, than when the liquid is subsequently sucked back after the discharge has ended. The switch between the throttling state, with intense throttling, and the release state, with only little throttling, is preferably realized automatically, as it were, so that the user does not need to consider any further measures beyond his or her normal handling steps for a liquid dispenser.

One possibility for designing a switchable throttle device lies in the provision of an elastically deformable wall section in the throttle device, said wall section being displaced by way of a pressure difference or associated operating parameters and thereby influencing the throttle channel in a throttling manner to different extents.

However, a design in which the throttle device has a throttle body which is able to be displaced between a release position and throttling position in the throttle channel is preferable. Said throttle body is preferably an inherently rigid body, which is normally produced from a plastic that is conventional in the dispensing sector and which, in dependence on its position, influences the flow resistance brought about by the throttle device. A formation of such a throttle body which, owing to the absence of requirement in terms of orientation, is advantageous is the formation of the spherical throttle body.

With respect to an upright position of the discharge head, the throttle body is preferably arranged at different heights in its release position and in its throttling position.

With such a design, the throttle body is able to be moved freely between the release position and the throttling position such that, in an upright position on the one hand and in an opposite, upside-down position on the other hand, it assumes, in one case, the release position under the action of gravitational force and, in the other case, the throttling position under the action of gravitational force.

With this embodiment, it is thus provided that the throttle body varies its position within the throttle channel under the action of gravitational force or, at least, also under the action of gravitational force. If the liquid dispenser and, with this, the discharge head is situated in an upright position, in which the discharge opening normally points upward and a base of the liquid dispenser, for placement of the dispenser, points downward, then the throttle body falls to its lowest possible position, which at the same time constitutes the release position of said body. It can thereby considerably reduce the flow resistance for the return flow of liquid from the outlet channel. If the dispenser and the discharge head are situated in an upside-down position, in which the base of the liquid dispenser points upward and/or the discharge opening points downward, then the throttle body falls in the opposite direction to its then lowermost possible position, which, with this orientation of the dispenser, is the throttling position. Here, the throttle body brings about an increase in the flow resistance in that it leaves only a relatively small part of the cross section of the throttle channel free for the throughflow of exiting liquid.

In order that the throttle body does not float, it preferably has a greater density than the liquid kept in the liquid store.

The throttle body may also be arranged in the throttle channel such that said body is displaced in the direction of its throttling position by the liquid flowing out through the throttle device and/or that said body is displaced in the direction of its release position by the liquid flowing in through the throttle device.

In this described configuration, the throttle body is arranged such that it is carried along automatically, as it were, by the liquid flow pointing in the one or the other direction and assumes its end position, the throttling position or the release position, in this way. For this purpose, the throttle body is in particular preferably able to be displaced between a throttling position and a release position, which are spaced apart from one another in the flow direction of the liquid.

Said technique makes it possible to do without the above-described difference in height of the throttling position and the release position of the throttle body. However, preferably the discharge head is designed such that the displacement of the throttle body is able to be varied both under the action of gravitational force and as a result of the flow. In this way, it is particularly reliably achieved that the throttle body assumes the throttling position during the discharge of liquid and the release position during the sucking-back of liquid. Specifically with highly viscous liquids, such as lotions and creams, it is an advantage if both the weight force and the liquid pressure bring about, in the same direction, the displacement of the throttle body.

Preferably, the throttle body, which is in particular preferably designed in the form of an elongate channel, has, at its ends and preferably at the two opposite end sides, an inflow opening and an outflow opening. The throttle body is arranged between said inflow opening and said outflow opening both in a release position and in its throttling position.

Additionally, the throttle channel preferably has at least one side opening, in particular in a lateral region of a cylindrical outer wall of the throttle channel, wherein the throttle body, when arranged in the throttling position, is arranged between the side opening and the outflow opening, and wherein the throttle body, when arranged in the release position, is not arranged between the side opening and the outflow opening.

This design accordingly makes provision for the division into two parts of the liquid path of the liquid from the liquid store up to the outflow opening, pointing in the discharge direction during discharge, of the throttle channel. On the one hand, liquid is able to enter the throttle channel through the in particular preferably end-side inflow opening. On the other hand, said liquid is able to enter the throttle channel through the described at least one side opening. Such a design is advantageous since, by being brought into its release position, the throttle body is, at it were, pulled out of the flow path of the liquid flowing back from the outlet channel. However, as a result of the end-side inflow opening, when liquid is discharged again, the throttle body is reliably subjected to force, and displaced, in the direction of its throttling position.

In a preferred configuration, the throttle device has an elastically deflectable spring device, by means of which the throttle body is subjected to force in the direction of its release position or in the direction of its throttling position.

The stated spring device can act either in the direction of the throttling position or in the direction of the release position. If it acts in the direction of the throttling position, then it is ensured to a particularly great extent that the throttle body particularly reliably assumes the throttling position after liquid has been sucked back into the liquid store. This is advantageous in particular since the situation in which, when the liquid dispenser is actuated, there is firstly a brief period of time until the throttle body has assumed its throttling position and during which liquid can escape in a non-throttled manner, is consequently prevented. When the throttle body is subjected to force in the direction of its release position by means of the spring device, it is ensured to a relatively great extent that the throttle body does not, for example due to the tackiness of the liquid to be discharged, remain in its throttling position and thereby prevent the liquid from the outlet channel from being sucked back.

The spring device may in particular be designed in the form of a plastic spring, preferably in the form of a helical spring composed of plastic. Furthermore, the spring device may be formed integrally with the throttle body.

The avoidance of metal as material for the spring device is considered to be advantageous owing to the risk of corrosion. Moreover, plastic springs are normally less expensive. A particularly simple design can be achieved if both the integrality between the spring device and the throttle body and the configuration from plastic are realized.

The throttle channel can preferably be outwardly delimited by an outer wall, in particular of elongate and cylindrical, preferably circular cylindrical, form. If one or more of the above-mentioned side openings are provided, this/these preferably break through the lateral surface-like outer wall. The throttle body is arranged within the throttle channel, wherein the throttle body and the outer wall of the throttle channel have corresponding stop surfaces, by which the throttle body is secured in the throttle channel.

The outer wall outwardly delimits the throttle channel and is preferably broken through by the outflow opening and the inflow opening, opposite one another, at the end sides. The throttle body is preferably secured in a form-fitting manner within the throttle channel by way of the stop surfaces. Preferably, an insertion bevel is assigned to each of the stop surfaces, so that the throttle body, when being fitted into the throttle channel, can, with deflection of the stop surfaces, be pushed into the throttle channel, subsequently however being securely protected therein from slipping out.

The outer wall of the throttle channel may in particular have a plurality of deflectable webs, preferably three or four webs, extending in a longitudinal direction of the throttle channel, at the end of which webs the stop surfaces for the throttle body are in particular preferably provided.

The use of a plurality of webs, in particular the use of three or four webs, leads to the throttle body being reliably guided in the throttle channel. Moreover, the regions between the webs serve as side openings in the above-described sense. The use of isolated webs also leads to said webs being able to be deflected independently of one another, with the result that a design in which the throttle body can, with deformation of the webs, be inserted into the throttle channel is relatively simple.

Preferably provided in the outlet channel is an outlet valve, which closes with small pressure difference but which, with sufficient positive pressure or negative pressure in the liquid store, opens bidirectionally, such that it not only permits discharge with sufficient positive pressure but also does not prevent the sucking-back of liquid into the liquid store. A discharge head according to the invention is provided for allowing the aeration of the liquid store via the outlet channel to be realized.

The liquid dispenser encompassed by the invention for dispensing liquid, in particular for dispensing cosmetic or pharmaceutical liquids, has a discharge head of the above-described type with a discharge opening for dispensing of liquid into a surrounding atmosphere. Said liquid dispenser also has a liquid store, which is connected to a housing of the discharge head by way of a detachable coupling device or an integral formation.

The liquid dispenser is preferably designed in the form of a drop dispenser.

It is important in particular with such a drop dispenser for the liquid to be throttled before being discharged, in order that drop formation can be reliably realized. However, it is also specifically here the case that reliable sucking-back of the medium from the outlet channel is highly relevant, since an outlet channel, once filled with dried medium, is barely able to be subjected to sufficient pressure, specifically owing to the throttling effect, in order to free said channel again from dried medium.

The liquid store may in particular be a squeeze bottle or a tube.

The inner volume of a liquid store for a liquid dispenser according to the invention is preferably less than 300 ml, preferably less than 100 ml, in particular preferably less than 50 ml.

The liquid store is preferably filled with a cosmetic or pharmaceutical liquid according to the intended application purpose.

BRIEF DESCRIPTION OF THE DRAWINGS

Further advantages and aspects of the invention will emerge from the claims and from the following description of preferred exemplary embodiments of the invention, which are discussed below on the basis of the figures.

DETAILED DESCRIPTION OF THE EXEMPLARY EMBODIMENTS

Figure 1:
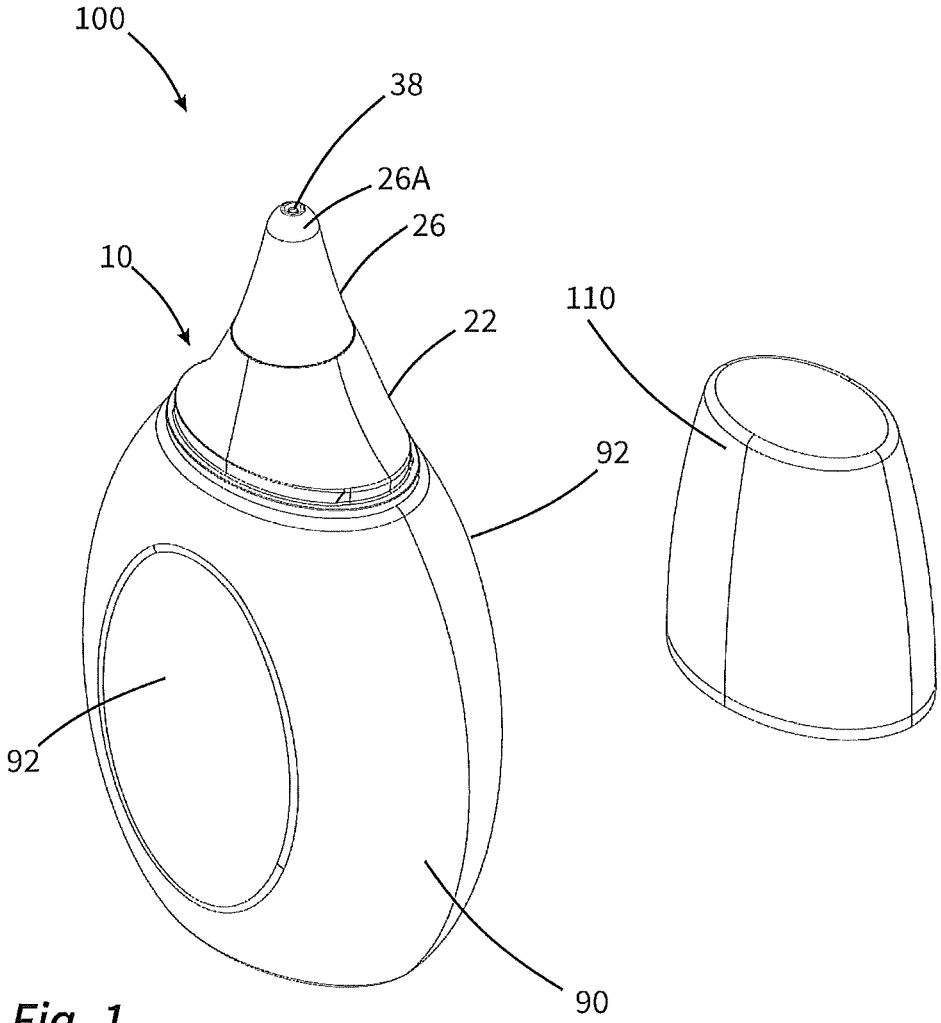
FIG. 1 shows a liquid dispenser according to the invention in an overall illustration.

FIG. 1 shows a liquid dispenser 100 according to the invention. This has, as a main component, a liquid store 90 in the form of a squeeze bottle, which is subjected to force as intended in the region of actuation surfaces 92 for the purpose of discharge. A discharge head 10, whose housing 20 consists of two components 22 and 26, is mounted on the liquid store 90. The component 26 is an applicator tip, on whose distal end there is provided a discharge opening 38 which is surrounded by a drop formation surface 26A in the form of a spherical cap. In order to protect the liquid dispenser from drying out, a cap 110 is provided.

Figure 2:
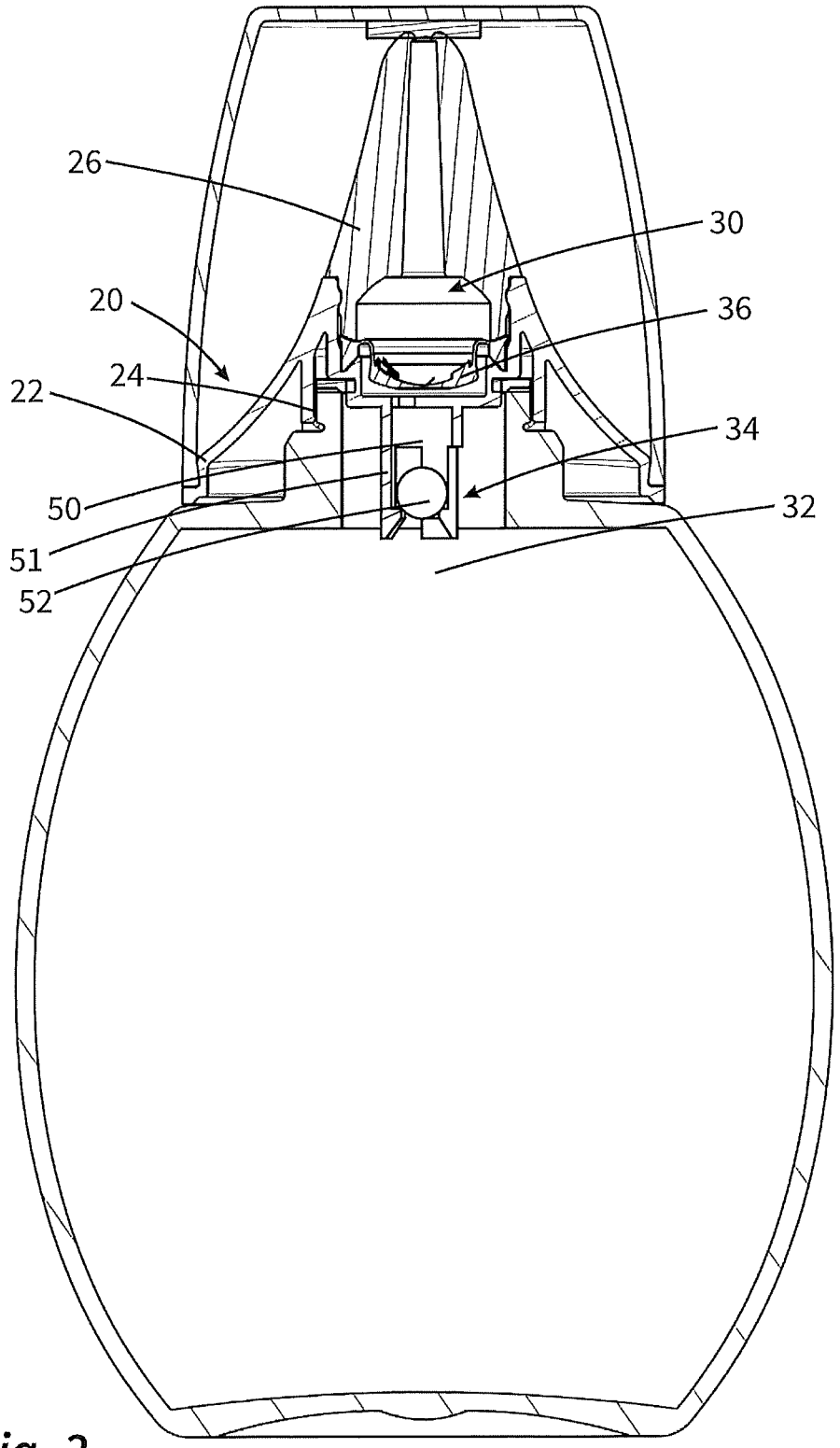
FIGS. 2 and 3A to 3C show a first exemplary embodiment of the liquid dispenser in a sectioned illustration, and the throttle device thereof when the liquid dispenser is in use.

FIG. 2 shows a first exemplary embodiment of the liquid dispenser 100 in a sectioned illustration. Just like the exemplary embodiments described below, the dispenser has the stated liquid store 90, to which is fastened the housing 20 with the base component 22 and the applicator component 26. For the purpose of latching, the base component 22 has a coupling device 24. As an alternative, an integral configuration would also be conceivable. An integral valve component of an outlet valve 36 is, with its edge region, is clamped in between the base component 22 and the applicator component 26.

Said valve component is provided in an outlet channel 30 which extends from an inlet region 32 on the liquid store side, through a throttle device 34 and the stated outlet valve 36, and up to the discharge opening 38.

If the liquid store 90 is subjected to force in the upside-down position of the liquid dispenser 100, with the discharge opening 38 pointing downward, the liquid passes from the inlet region 32, through the throttle device 34 and the outlet valve 36, and up to the discharge opening 38, and there, is released in drop form. As soon as the discharge has been completed and the user stops subjecting the liquid store 90 to force, the result is a negative pressure in the liquid store and the intention is for the liquid from the outlet channel to be sucked back into the liquid store.

The stated throttle device 34 is designed so that, when liquid is discharged, it throttles said liquid sufficiently such that the release of a continuous jet is prevented and instead the desired drop release takes place. However, during the sucking-back, it is intended that no or little throttling is realized, in order that the liquid can pass as completely as possible back into the liquid store 90.

The construction described here is fundamentally identical for all three exemplary embodiments described below.

Figure 3A:
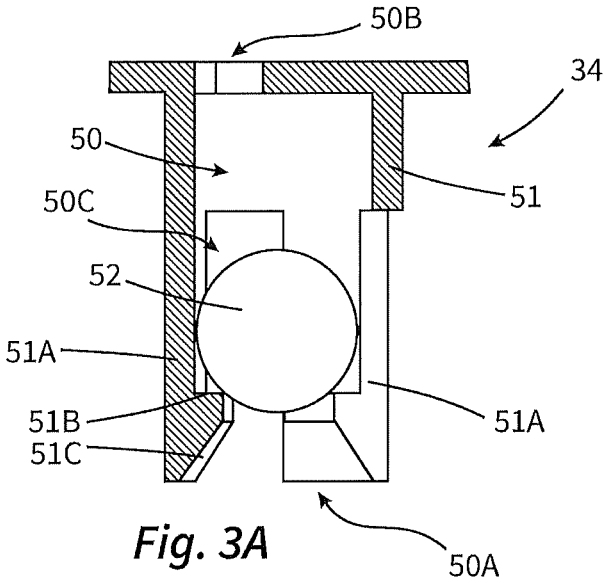
Figure 3B:
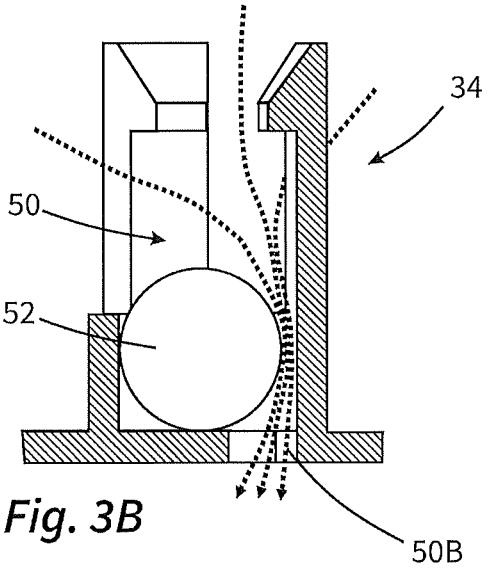
Figure 3C:
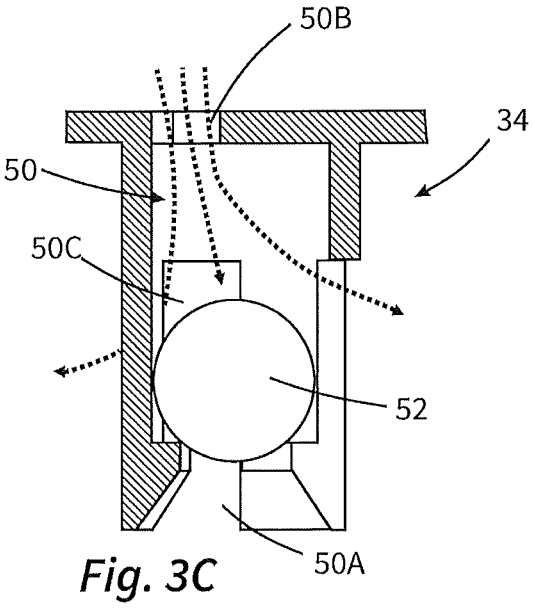

The throttle device 34 of the first exemplary embodiment in FIGS. 2 to 3C consists of merely two constituent parts, namely an outer wall 51, which is of approximately cylindrical design and surrounds a throttle channel 50, and a throttle body 52, which is arranged in the throttle channel 50 and, in the case of this configuration, is designed in the form of a spherical body.

The functioning of the throttle device 34 will be discussed on the basis of FIGS. 3A to 3C.

FIG. 3A shows an initial state. When the liquid dispenser 100 is not being used and stands upright according to FIG. 2, the throttle body 52 bears, at the distal end of the throttle channel 50, on stop surfaces 51B which are formed on the inside of the outer wall 51 at the distal end. Provided opposite said stop surfaces 51B are insertion bevels 51C which, during the assembly, allow the throttle body 52 to be introduced into the throttle channel 50, with deflection of three outer wall webs 51A of the outer wall 51.

If, proceeding from the state in FIG. 3A, the use then begins, then the user positions the dispenser upside-down, with the result that the throttle device 34 assumes the position in FIG. 3B. In this way, the throttle body 52 falls under the action of gravitational force onto the opposite, proximal end of the throttle channel 50, at which end the outflow opening 50B is provided. If, owing to the difference in density between the throttle body 52 and the surrounding liquid being too small, the gravitational force is not sufficient to bring the throttle body 52 into the position in FIG. 3B, then this will however be achieved at the latest by the applied pressure in the liquid and the flow thereof.

As can be seen referring to the dotted lines in FIG. 3B, the passage path through the throttle channel 50 for the liquid toward an outlet opening 50B is then significantly narrowed. The throttle body 52 fills most of the cross section of the throttle channel 50 immediately in front of the outflow opening 50B and thus brings about intense throttling of the liquid. Even if the user 90 applies force intensely to the liquid store 90, a drop formation is therefore, as desired, the result.

After the discharge process has ended, the dispenser is brought into its upright position in FIG. 2 again. As can be seen in FIG. 3C, the throttle body 52 then falls again onto the distal end of the throttle channel 50 in the region of the inflow opening 50A, with the result that, owing to the negative pressure in the liquid store 90, liquid from the outlet channel is sucked back into said liquid store without any problems. The liquid flowing back assists this displacement of the throttle body 52.

Although the spherical throttle body 52 still takes up the same amount of space in the unchanging cross section of the throttle channel 50, the liquid flowing back is then able to pass back into the liquid store 90 through side openings 50C, which are provided between the deflectable outer wall webs 51A, with only little throttling.

Figure 4:
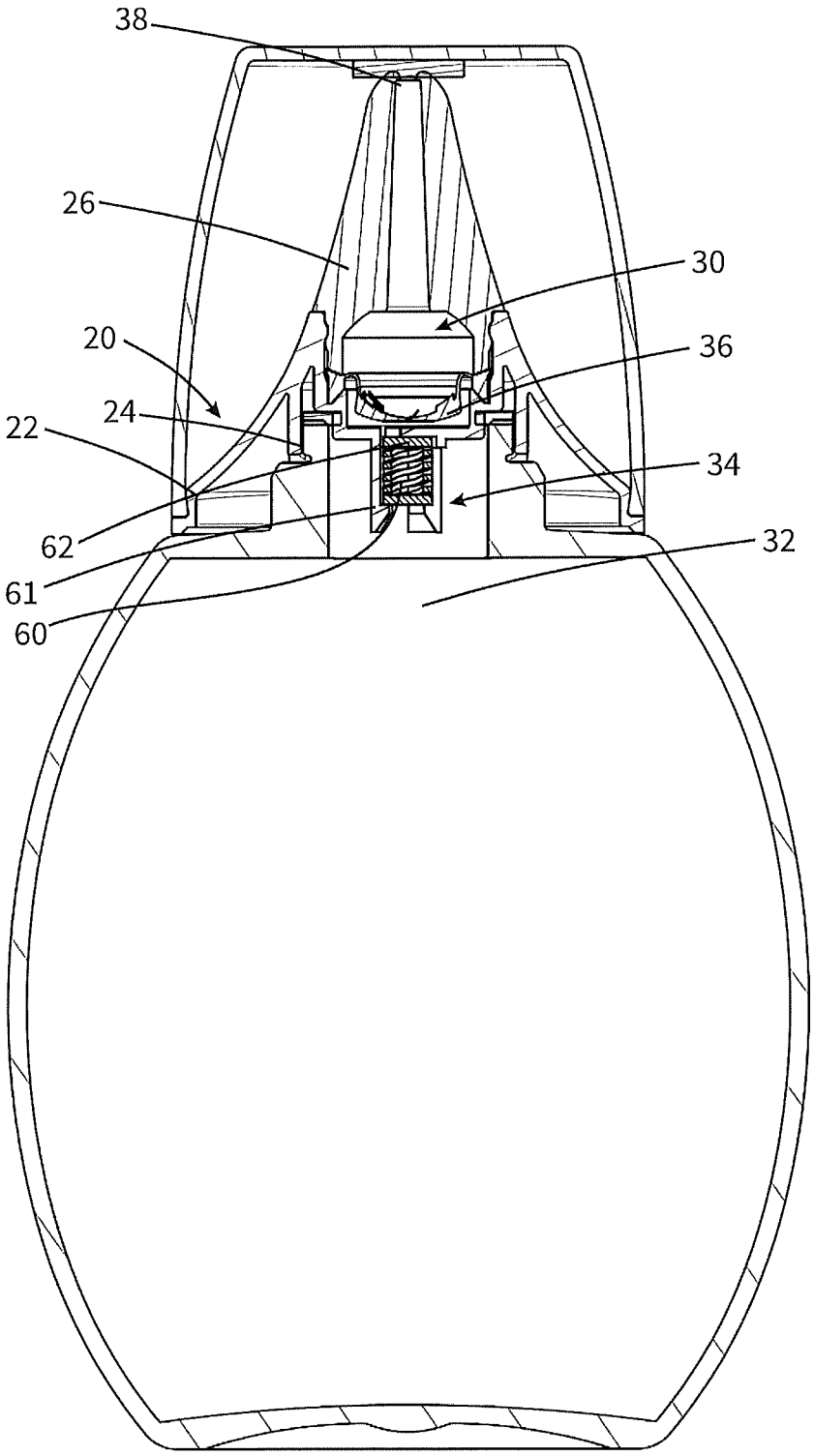
FIGS. 4 and 5A to 5C show a second exemplary embodiment of the liquid dispenser in a sectioned illustration, and the throttle device thereof when the liquid dispenser is in use.
Figure 5A:
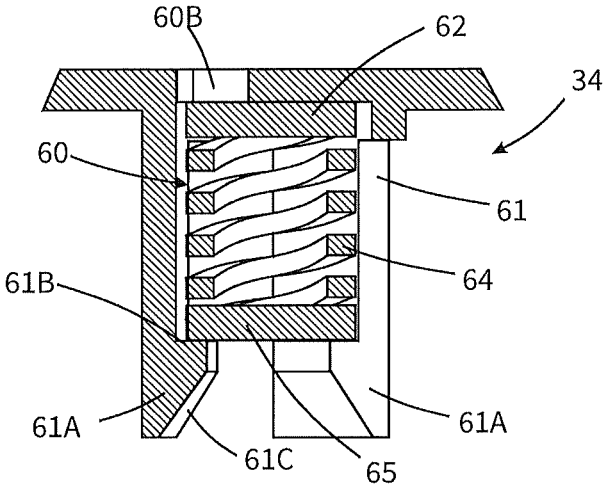
Figure 5B:
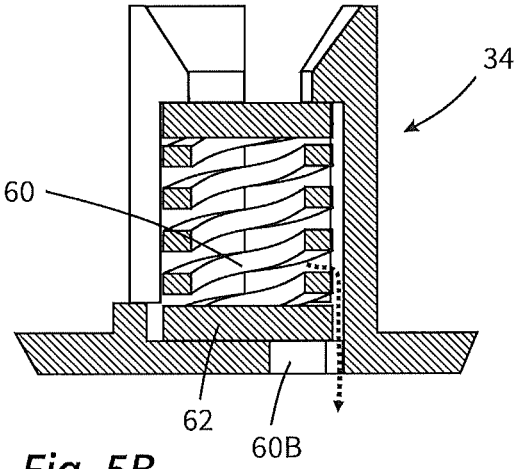
Figure 5C:
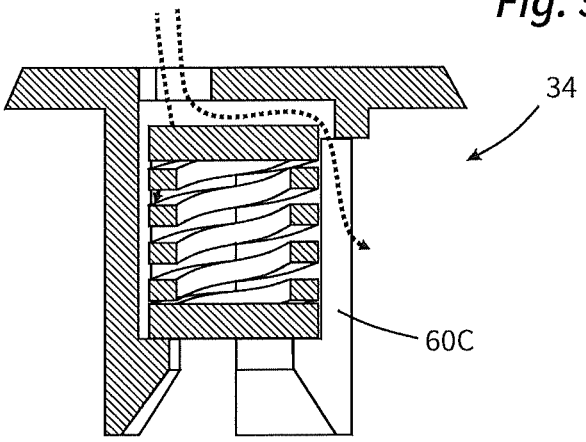
Figure 6:
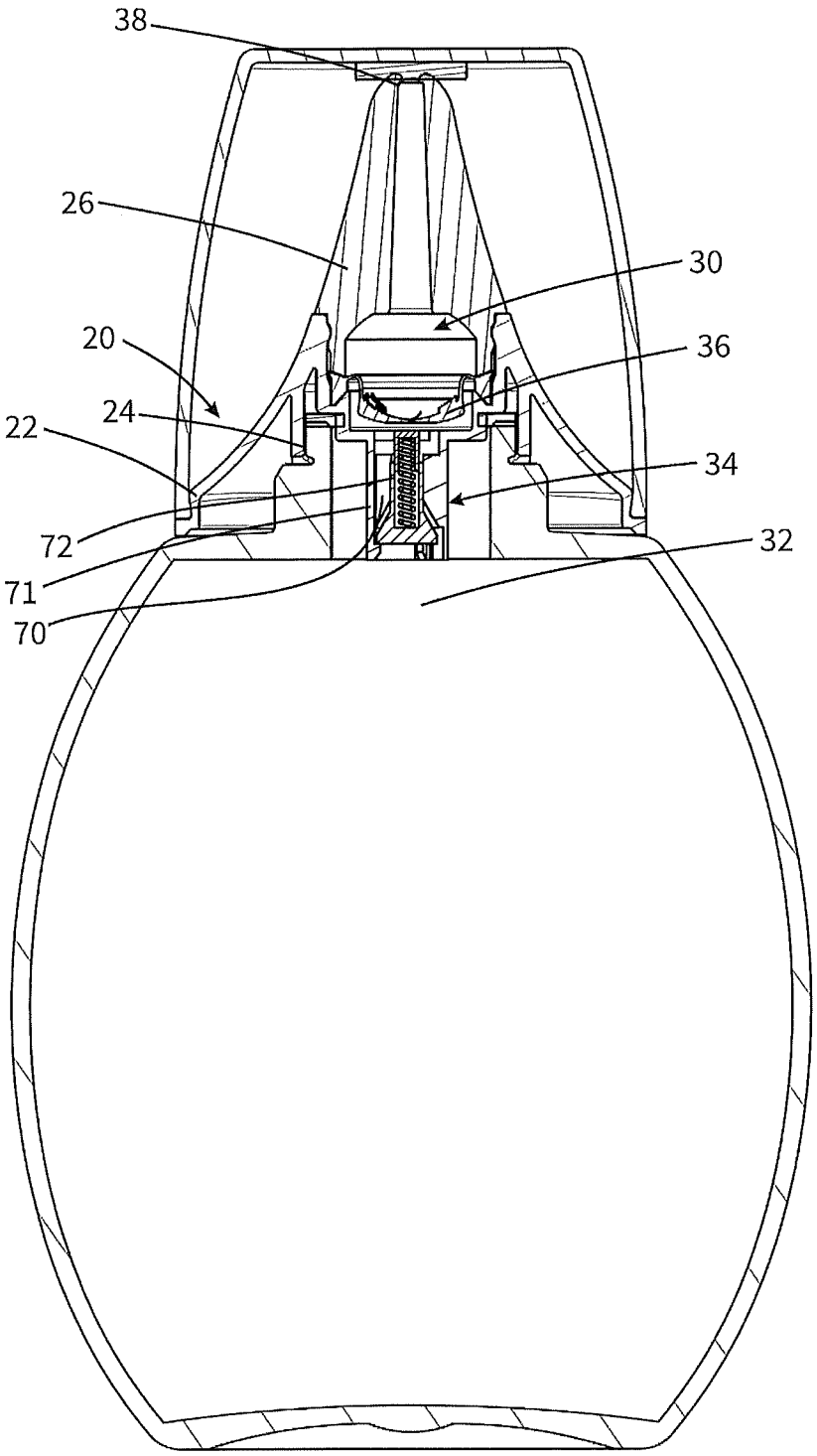
FIGS. 6 and 7 and 8A to 8C show a second exemplary embodiment of the liquid dispenser in a sectioned illustration, and the throttle device thereof in a perspective illustration and when the liquid dispenser is in use.
Figure 7:
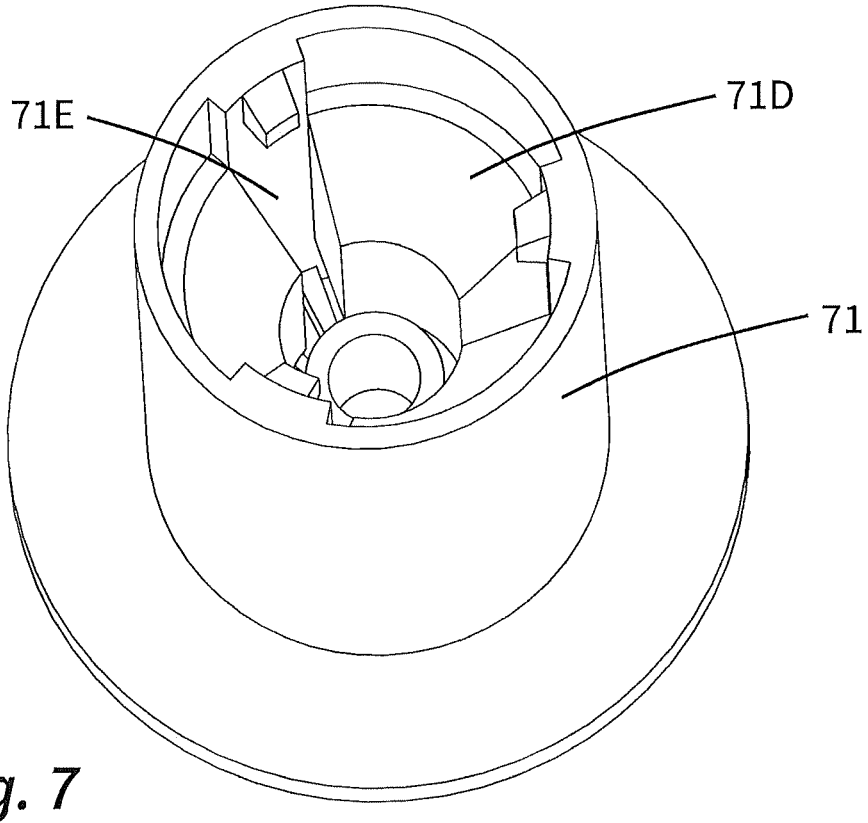

In the configuration as per FIGS. 4 to 5C, the throttle device is designed slightly differently.

As can be seen referring to FIGS. 5A to 5C, the outer wall 61 of the throttle device 34 is designed here in a manner very similar to that in the preceding variant. It again has mutually spaced apart outer wall webs 61A extending in the longitudinal direction and having end-side stop surfaces 61B and insertion bevels 61C. In this way, a throttle body 62 is secured in the throttle channel 60.

In contrast to the preceding exemplary embodiment, the throttle body 62 is designed here in the form of a disk-shaped throttle body and, moreover, is integrally connected to a spring device 64 in the form of a plastic helical spring, on whose side which is opposite the throttle body 62 a counter bearing disk 65 is provided.

The sequence corresponding to the sequence described with respect to FIGS. 3A to 3C leads here to the following behavior.

In the upside-down position for discharge, as illustrated in FIG. 5B, the throttle body 62 is pushed against the proximal end of the throttle channel 60 and, in this way, closes off most of the outflow opening 60B. The liquid is consequently able to pass to the discharge opening 38 only in an intensely throttled form and is thus reliably released here in drop form.

After the discharge process has ended, however, the throttle body 62 is, during the sucking-back of liquid from the outlet channel 30, deflected by the liquid in the manner shown in FIG. 5C, with the result that the throttling effect is significantly reduced. In this way, much of the liquid can be reliably sucked from the outlet channel 30 back into the liquid store 90 through the throttle device 34. In this case, it exits the throttle device through the side openings 60C since, in this variant, an end-side inflow opening is permanently closed off by the counter bearing disk 65. It would however also be possible for said counter bearing disk to be designed with an aperture, in order to facilitate the exchange of liquid between the throttle channel 60 and the liquid store 90.

Figure 8A:
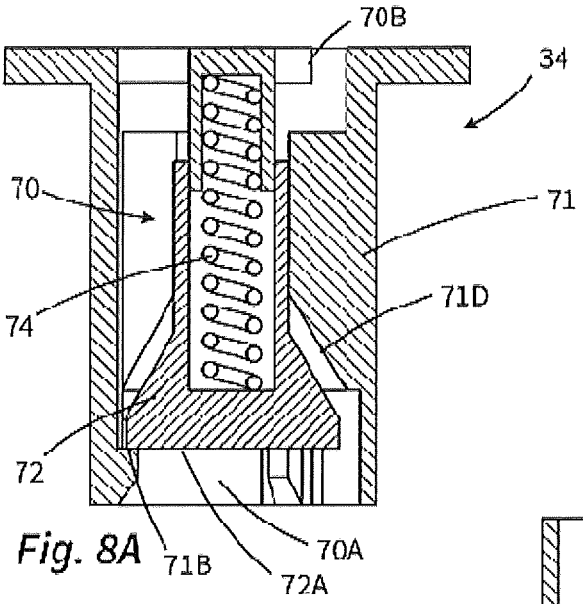
Figure 8B:
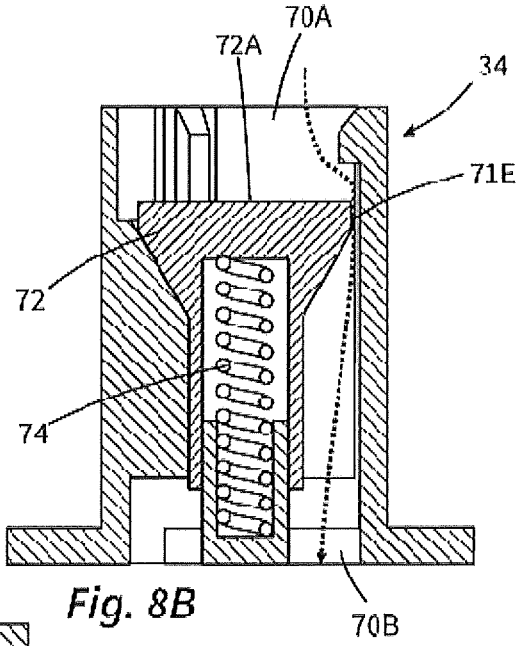
Figure 8C:
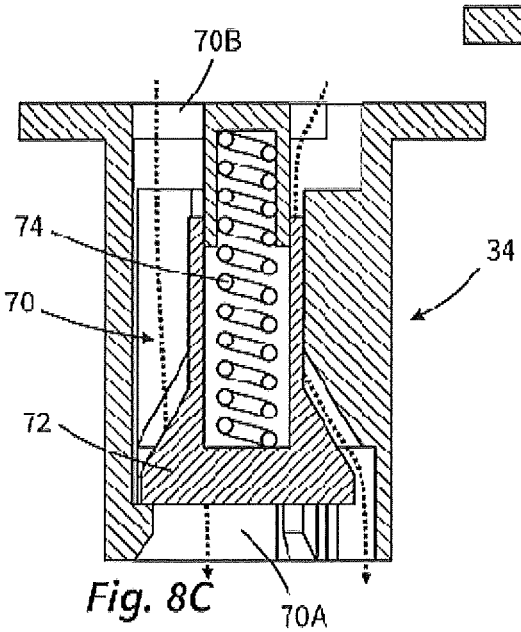

In the exemplary embodiment as per FIGS. 6 to 8C, the throttle device 34 likewise has a throttle channel 70 which extends from an inflow opening 70A up to an outflow opening 70B. In said throttle channel 70, provision is again made of a throttle body 72, which, as can be seen in FIGS. 8A to 8C, is able to be displaced in relation to the housing 20 and the outer wall 71 by means of sliding sleeves. As can be seen from the illustration in FIG. 7, a conical surface 71D which is interrupted in the region of three cutouts 71E is provided on the inner side of the outer wall 71.

The correspondingly likewise partially conically shaped throttle body 72 is, as in the exemplary embodiment in FIGS. 4 and 5, subjected to force by a spring device 74, in this case preferably designed in the form of a metallic helical spring, in the direction of its release position, illustrated in FIG. 8A.

As illustrated in FIG. 8B, during a discharge, the throttle body 72 is subjected to force in the region of the end side 72A thereof and is consequently pushed into the position in FIG. 8B, in which the conical portion-shaped sub-surfaces of the outer wall 71 and of the throttle body 72 bear against one another. During discharge, a liquid flow can therefore still be realized only through the apertures 71E illustrated in FIG. 7. In FIG. 8B, this is shown by the dotted line. The liquid stream is thus intensely throttled and is consequently suitable for drop release.

After the discharge process has ended, the throttle body 72 is, even before the dispenser is brought into its upright position again, —pushed back into its position in FIGS. 8A and 8C by the spring device 74 such that, as illustrated by the dotted lines, the liquid from the outlet channel can be sucked back into the liquid store with only low flow resistance.

The invention claimed is:

1. A discharge head for a liquid dispenser, said discharge head comprising:

a housing;

a coupling device configured for attachment to a liquid store;

a discharge opening through which liquid is dispensed into a surrounding atmosphere;

an inlet region disposed adjacent the liquid store;

an outlet channel extending from said inlet region to said discharge opening, said outlet channel being configured to supply said discharge opening with liquid from the liquid store; and a throttle device disposed in said outlet channel, said throttle device being configured to accommodate liquid flow therethrough in a first direction towards said discharge opening and in a second direction towards said inlet region, said throttle device having a throttle channel with a variable cross-section, said throttle device being configured for switching between a throttling state and a release state to vary said cross-section of said throttle channel and produce a throttling effect on liquid flowing through said throttle device and said throttle channel, said throttling effect comprising a reduction in a pressure and/or a flow of liquid flowing through said throttle device and said throttle channel, said throttle device in said throttling state causing said throttling effect on liquid flowing in said first direction through said throttle device and said throttle channel, said throttle device in said release state causing said throttling effect on liquid flowing in said second direction through said throttle device and said throttle channel, said throttling effect in said release state being less than said throttling effect in said throttling state.

2. The discharge head according to claim 1, wherein said throttle device comprises a throttle body disposed in said throttle channel, said throttle body being displaceable between a release position and a throttling position, said throttle body being disposed in said release position in said release state of said throttle device and being disposed in said throttling position in said throttling state of said throttle device.

3. The discharge head according to claim 2, wherein said discharge head has an upright position in which said discharge opening is oriented above said inlet region and an upside-down discharge position in which said discharge opening is oriented below said inlet region, said throttle body being disposed at different heights in said release position and in said throttling position with respect to said upright position of said discharge head, said throttle body being freely movable between said release position and said throttling position such that said throttle body is displaced into said release position under action of gravitational force in said upright position of said discharge head and is displaced into said throttling position under action of gravitational force in said upside-down discharge position of said discharge head.

4. The discharge head according to claim 3, wherein said throttle body is displaced in a direction towards said throttling position by liquid flowing in said first direction through said throttle device and is displaced in a direction towards said release position by liquid flowing in said second direction through said throttle device.

5. The discharge head according to claim 2, wherein said throttle channel includes an inflow opening at one end thereof and an outflow opening at an opposite end thereof, said throttle body being disposed between said inflow opening and said outflow opening in both said release position and said throttling position, said throttle channel further including at least one side opening disposed between said inflow opening and said outflow opening, said throttle body being disposed between said side opening and said outflow opening in said throttling position and said throttle body not being disposed between said side opening and said outflow opening in said release position.

6. The discharge head according to claim 5, wherein said throttle device comprises an outer wall including a plurality of deflectable outer wall webs extending in a longitudinal direction of said throttle channel, and said at least one side opening is disposed between two adjacent ones of said outer wall webs.

7. The discharge head according to claim 6, wherein said throttle body is spherical.

8. The discharge head according to claim 2, wherein said throttle device comprises an outer wall defining said throttle channel and said throttle body is disposed inside said outer wall, said throttle body and said outer wall each comprising a stop surface, said stop surfaces cooperating with one another to secure said throttle body in said throttle channel.

9. The discharge head according to claim 8, wherein said outer wall comprises a plurality of outer wall webs extending in a longitudinal direction of said throttle channel, said outer wall webs being configured for deflection, said stop surface of said outer wall being disposed adjacent ends of said outer wall webs.

10. The discharge head according to claim 2, wherein said throttle body is spherical.

11. The discharge head according to claim 2, wherein said throttle device comprises a spring disposed to bias said throttle body in a direction towards said release position or in a direction towards said throttling position.

12. The discharge head according to claim 11, wherein said spring comprises a helical plastic spring or said spring is integrally formed with said throttle body.

13. The discharge head according to claim 2, wherein said throttle body is displaceable within said throttle channel between a release position and a throttling position, said throttle body being disposed in said release position in said release state of said throttle device and being disposed in said throttling position in said throttling state of said throttle device, said throttle channel having a first opening at one end thereof disposed adjacent said inlet region and a second opening at an opposite end thereof disposed adjacent said discharge opening, and said throttle member being disposed closely adjacent said second opening in said throttling position.

14. The discharge head according to claim 1, further including an outlet valve disposed in said outlet channel downstream, with respect to liquid flow in said first direction, of said throttle device, wherein:

said outlet valve is configured to close automatically in a pressure interval between a defined inlet-side negative pressure and a defined inlet-side positive pressure and is configured to open when said defined inlet-side negative pressure is exceeded and when said defined inlet-side positive pressure is exceeded;

and/or said outlet valve comprises elastic material and comprises a bulge having a valve opening closable by valve lips, said valve lips, with an increasing inlet-side positive pressure, being increasingly pressed against one another by said increasing inlet-side positive pressure up to an attainment of an inlet-side limit pressure for positive pressure.

15. The discharge head according to claim 1, wherein said throttle device is configured for switching between said throttling state and said release state to vary said cross-section of said throttle channel and vary a path of liquid flowing through said throttle device to produce said throttling effect, said throttle device comprising a throttle body disposed in said throttle channel and displaceable within said throttle channel to vary said path of liquid flowing through said throttle device, said throttle body being displaceable within said throttle channel between a release position and a throttling position, said throttle body being disposed in said release position in said release state of said throttle device and being disposed in said throttling position in said throttling state of said throttle device, said path of liquid when said throttle body is disposed in said throttling position being different from said path of liquid when said throttle body is disposed in said release position.

16. A liquid dispenser for dispensing cosmetic or pharmaceutical liquids, said liquid dispenser comprising:

a liquid store; and a discharge head having a housing formed integrally with or detachably coupled to said liquid store, said discharge head comprising:

a discharge opening through which liquid is dispensed into a surrounding atmosphere;

an inlet region disposed adjacent said liquid store;

an outlet channel extending from said inlet region to said discharge opening, said outlet channel being configured to supply said discharge opening with liquid from said liquid store; and a throttle device disposed in said outlet channel, said throttle device being configured to accommodate liquid flow therethrough in a first direction towards said discharge opening and in a second direction towards said inlet region, said throttle device having a throttle channel with a variable cross-sectional configuration, said throttle device being configured for switching between a throttling state and a release state to vary said cross-sectional configuration of said throttle channel and produce a throttling effect on liquid flowing through said throttle device and said throttle channel, said throttling effect comprising a reduction in a pressure and/or a flow of liquid flowing through said throttle device and said throttle channel, said throttle device in said throttling state causing said throttling effect on liquid flowing in said first direction through said throttle device and said throttle channel, said throttle device in said release state causing said throttling effect on liquid flowing in said second direction through said throttle device and said throttle channel, said throttling effect in said release state being less than said throttling effect in said throttling state.

17. The liquid dispenser according to claim 16, wherein said liquid dispenser is configured as a drop dispenser, and/or said liquid dispenser is configured as a squeeze bottle or a tube, and/or an inner volume of said liquid store is less than 300 ml, and/or said liquid store is filled with a cosmetic or a pharmaceutical liquid.

18. A discharge head for a liquid dispenser, said discharge head comprising:

a housing;

a coupling device configured to attach said discharge head to a liquid store;

a discharge opening through which liquid is dispensed into a surrounding atmosphere;

an inlet region into which liquid from the liquid store enters said discharge head;

an outlet channel configured to provide communication between said discharge opening and said inlet region; and a throttle device disposed in said outlet channel between said inlet region and said discharge opening such that liquid stored in the liquid store flows through said throttle device, said throttle device comprising a throttle channel which accommodates liquid therein, said throttle device being configured for switching between a throttling state and a release state to produce a throttling effect comprising a reduction in liquid pressure and/or liquid flow of the liquid flowing through said throttle device and said throttle channel, said throttle channel in said throttling state of said throttle device having a first fluid-accommodating cross-sectional configuration to produce said throttling effect on liquid flowing through said throttle device and said throttle channel in a direction towards said discharge opening, and said throttle channel in said release state of said throttle device having a second fluid-accommodating cross-sectional configuration, different from said first fluid-accommodating cross-sectional configuration, to produce said throttling effect on liquid flowing through said throttle device in a direction towards said inlet region, said throttling effect in said release state of said throttle device being less than said throttling effect in said throttling state of said throttle device.

19. The discharge head according to claim 18, wherein said throttle device comprises a throttle body disposed within said throttle channel, said throttle body being displaceable within said throttle channel between a release position and a throttling position, said throttle body being disposed in said release position in said release state of said throttle device and being disposed in said throttling position in said throttling state of said throttle device, said first and second fluid-accommodating cross-sectional configurations defining respective flow paths for liquid flowing through said throttle device, said flow paths being different from one another.

20. The discharge head according to claim 19, wherein said discharge head has an upright position in which said discharge opening is oriented above said inlet region and an upside-down discharge position in which said discharge opening is oriented below said inlet region, wherein one or both of gravitational force, or a force generated by the flow of liquid through said throttle channel in the direction towards said discharge opening, in said upside-down discharge position of said discharge head displaces said throttle body into said throttling position and wherein one or both of gravitational force, or a force generated by the flow of liquid through said throttle channel in the direction towards said inlet region, in said upright position of said discharge head displaces said throttle body into said release position.

21. The discharge head according to claim 20, wherein said throttle body is freely movable within said throttle channel between said throttling position and said release position.

* * * * *